US007488232B2

(12) United States Patent
Yang

(10) Patent No.: US 7,488,232 B2
(45) Date of Patent: Feb. 10, 2009

(54) DECORATIVE DEVICE ENABLING ORNAMENTS TO REVOLVE ON A ROTARY SCREEN INSIDE A CRYSTAL BALL AMIDST FLUTTERING, SHINY DISC SNOWFLAKES

(75) Inventor: Shin-Ya Yang, Hsin Tien (TW)

(73) Assignee: Ya Yung Enterprise Co., Ltd., Taipei Hsien (TW)

( * ) Notice: Subject to any disclaimer, the term of this patent is extended or adjusted under 35 U.S.C. 154(b) by 168 days.

(21) Appl. No.: 11/709,606

(22) Filed: Feb. 22, 2007

(65) Prior Publication Data

US 2008/0202002 A1 Aug. 28, 2008

(51) Int. Cl.
*A63H 23/08* (2006.01)

(52) U.S. Cl. ..... 446/267; 40/409

(58) Field of Classification Search ..... 74/413, 74/412 R; 446/267; 40/409, 410
See application file for complete search history.

(56) References Cited

U.S. PATENT DOCUMENTS 4,939,859 A * 7/1990 Bradt ..... 40/406
5,134,795 A * 8/1992 Wang ..... 40/411
5,603,994 A * 2/1997 Su ..... 428/11
5,666,750 A * 9/1997 Segan et al. ..... 40/410
6,346,026 B1 * 2/2002 Chen ..... 446/267

* cited by examiner

*Primary Examiner*—David M Fenstermacher
(74) *Attorney, Agent, or Firm*—Pro-Techtor Int'l Services

(57) ABSTRACT

A decorative device enabling ornaments to revolve on a rotary screen inside a crystal ball amidst fluttering, shiny disc snowflakes, which uses a device structured from a motor mechanism, a gear mechanism, a rotary screen mechanism and a crystal ball so that when a motor drives and rotates transmission gears of the gear mechanism, apart from using mutually repelling of two double-sided magnets to drive and rotate a magnet impeller wheel, and thereby cause whirling of water and fluttering of shiny disc snowflakes within the crystal ball, moreover, a main transmission shaft is also driven, thereby driving and causing a PVC (polyvinyl chloride) rotary screen to revolve.

1 Claim, 5 Drawing Sheets

DECORATIVE DEVICE ENABLING ORNAMENTS TO REVOLVE ON A ROTARY SCREEN INSIDE A CRYSTAL BALL AMIDST FLUTTERING, SHINY DISC SNOWFLAKES

BACKGROUND OF THE INVENTION (a) Field of the Invention

The present invention relates to a design of a snowflakes crystal ball, and more particularly to a multifunctional design of a snowflakes crystal ball enabling ornaments to revolve on a rotary screen inside a crystal ball amidst fluttering, striking shiny disc snowflakes.

(b) Description of the Prior Art

Liquid flowing inside a conventional snowflake crystal ball causes the fluttering of shiny discs, thereby forming the striking appearance of fluttering snowflakes. However, toy figurines or ornaments disposed interior of the crystal ball are not provided with functionality to move up and down or sway from side to side, and thus the crystal ball is merely provided with the function to produce the impression of striking snowflakes. Hence, there is a need for improvement on prior art.

SUMMARY OF THE INVENTION

A primary object of the present invention is to provide a striking snowflakes crystal ball of prior art with distinctive toy figurines or ornaments disposed interior thereof, in addition, transmission gears are used to cause a PVC (polyvinyl chloride) rotary screen to revolve, thereby providing a multipurpose snowflakes crystal ball that is able to alter appearance of ornaments within the crystal ball.

To enable a further understanding of said objectives and the gear mechanism 20.

Referring to FIG. 3, wherein the motor mechanism 10 is structured to comprise a motor 11, a gear set supporting frame 12, a gear set gland 13, four transmission gears 14, gear shafts 15, a magnet gland 16, a double-sided magnet 17 and a transmission magnet gland 18. The four transmission gears 14 and a transmission gear 141 are installed between the gear set supporting frame 12 and the gear set gland 13 (see FIG. 5), and the motor 11 is installed beneath the gear set supporting frame 12. The gear shafts 15 are linked to the transmission gears 14, and, after penetrating the gear set gland 13, respectively penetrate the magnet gland 16, the double-sided magnet 17 and the transmission magnet gland 18. The gear mechanism 20 is structured to comprise a carrier frame 21, a gland 22, a magnet impeller shaft 23, two air rubber plugs 24, a magnet gland 25, a double-sided magnet 26, a magnet impeller 27, a watertight gasket 28 and a main transmission shaft 29. The gland 22 is disposed on and covers a recess 211 of the carrier frame 21, and two air rubber plug holes 212 defined in the recess 211 enable the two air rubber plugs 24 to be respectively embedded therein. The magnet impeller shaft 23 center of the recess 211 respectively penetrates the magnet gland 25, the double-sided magnet 26 and the magnet impeller 27. A watertight ring support 213 at one end of the recess 211 enables the watertight gasket 28 and the main transmission shaft 29 to be disposed interior thereof, and watertight plastic plug holes 214 each having a watertight plug 2141 and an expanding bolt 2142 fixedly bolted therein are respectively defined lateral to the recess 211. A lower portion of the carrier frame 21 is provided with fixing posts 215, and screws A penetrate the gear set supporting frame 12 and are fixedly bolted within post holes of the fixing posts 215.

Referring to FIG. 4, which shows the rotary screen mechanism 30 that drives structural members comprising a main power transmission member 31, a gear set supporting frame 32, a main transmission gear 33, a transmission gear set 34, a gear set gland 35, a plurality of LEDs (light-emitting diodes) 36, two transmission bushings 37, two fixing shafts 38 and a gland 39. The main power transmission member 31 is embedded to an embedding piece 291 of the main transmission shaft 29 (see FIG. 3), and another end of the main power transmission member 31 is joined to the main transmission gear 33, which penetrates the gear set supporting frame 32. The gear set supporting frame 32 is fixedly bolted to the gland 22 of the gear mechanism 20 using screws A, moreover, the gear set supporting frame 32 is provided with four position fixing shafts 321. Four gears 341, 342, 343, 344 are respectively shaft joined to the position fixing shafts 321 and mutually mesh. Side of the leftmost side gear 344 meshes with a transmission gear 345, a left side of the main transmission gear 33 meshes with the gear 341 and a right side meshes with a transmission gear 331. The aforementioned gears are covered atop with the gear set gland 35, on an upper surface of which is configured with the plurality of LEDs 36. The transmission bushings 37 on left and right sides of the gear set gland 35 and the fixing shafts 38 configured interior thereof respectively penetrate the gear set gland 35, and the two fixing shafts 38 are respectively shaft joined to the transmission gears 331, 345. The entire PVC (polyvinyl chloride) rotary screen mechanism 30 is wire wrap connected to the two transmission technological methods of the invention herein, brief description of the drawings is provided below followed by detailed description of the preferred embodiments.

DETAILED DESCRIPTION OF THE PREFERRED EMBODIMENTS

Figure 1:
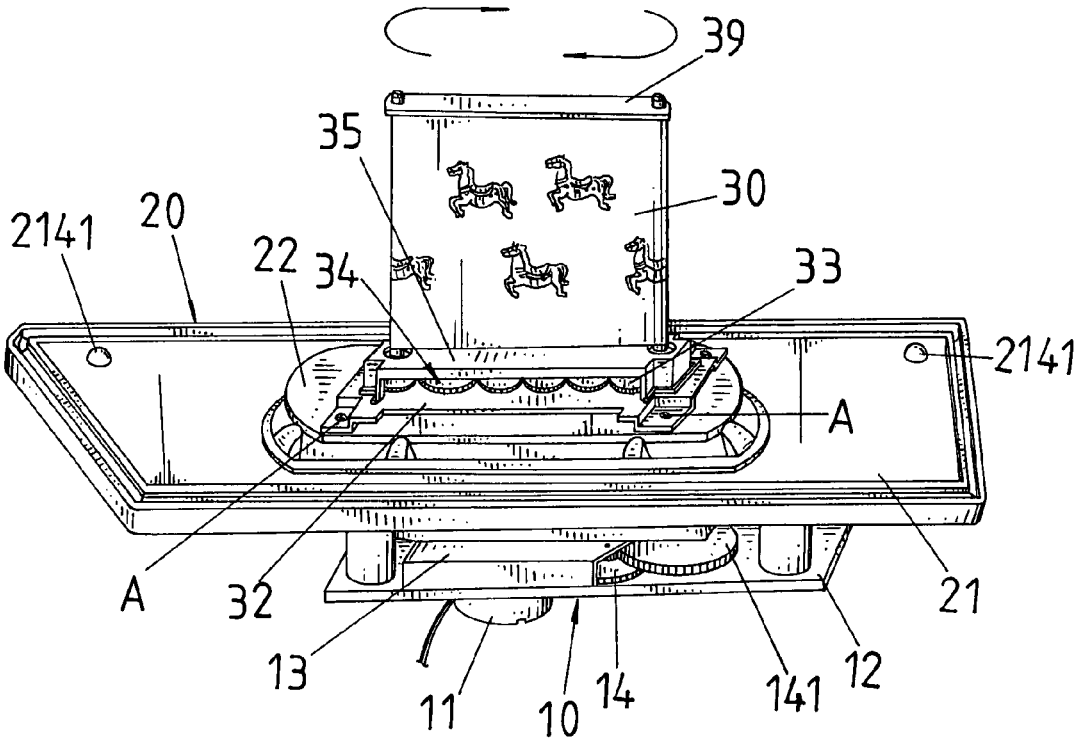
FIG. 1 shows an elevational view depicting assembly of a motor mechanism, gear mechanism and rotary screen mechanism according to the present invention.
Figure 2:
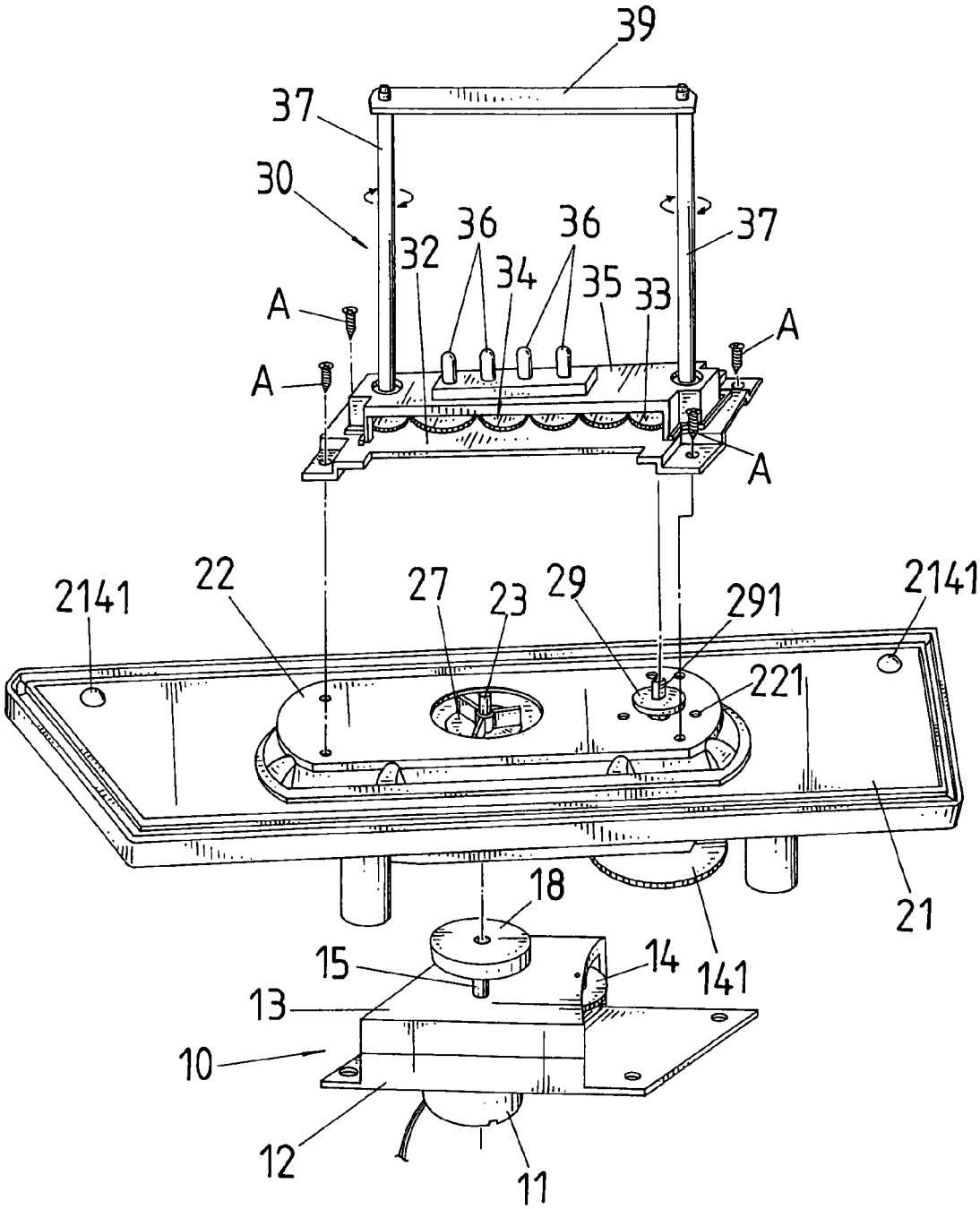
FIG. 2 shows an exploded elevational view of the motor mechanism, the gear mechanism and the rotary screen mechanism according to the present invention.
Figure 3:
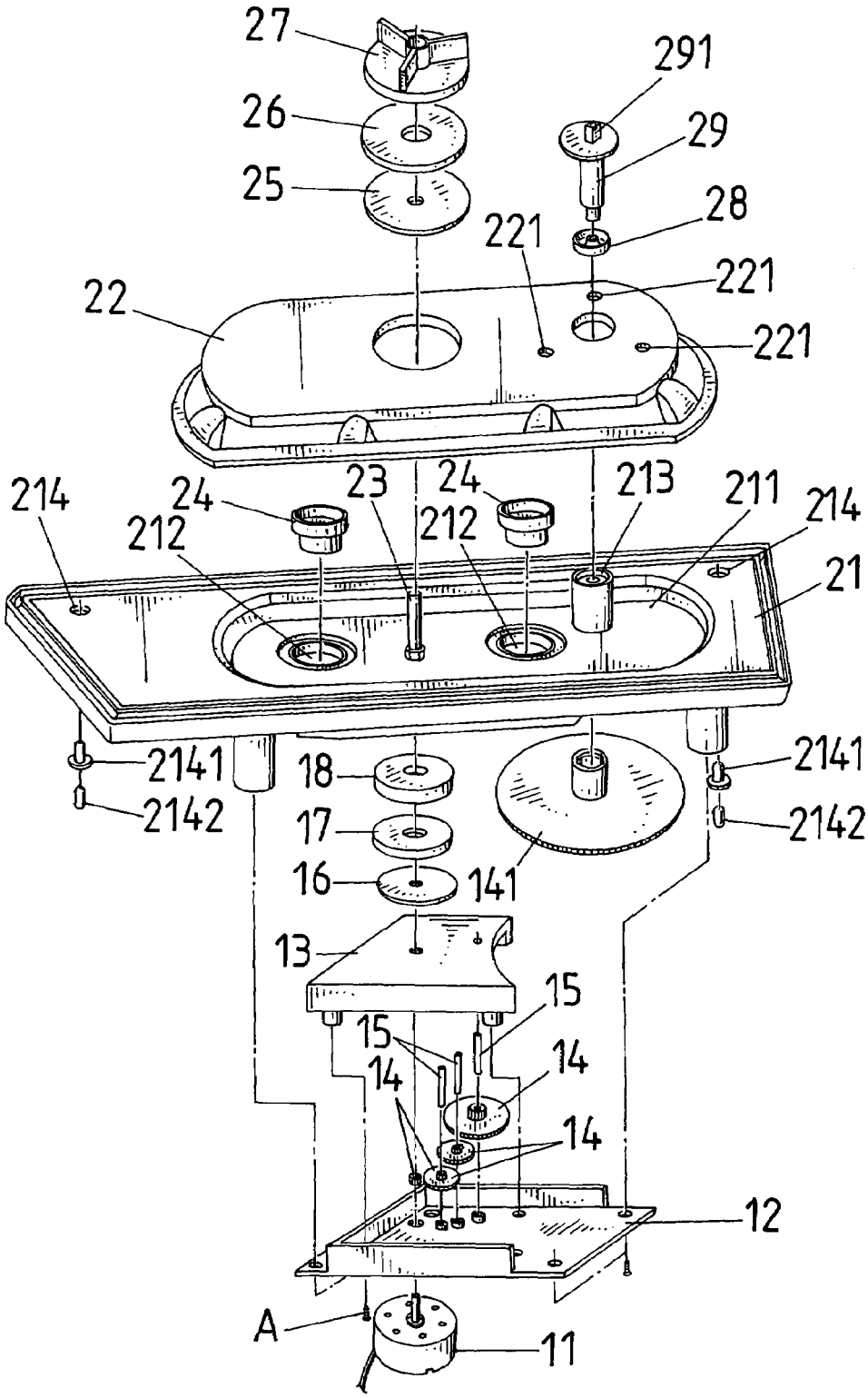
FIG. 3 shows an exploded elevational view of the motor mechanism and the gear mechanism according to the present invention.
Figure 4:
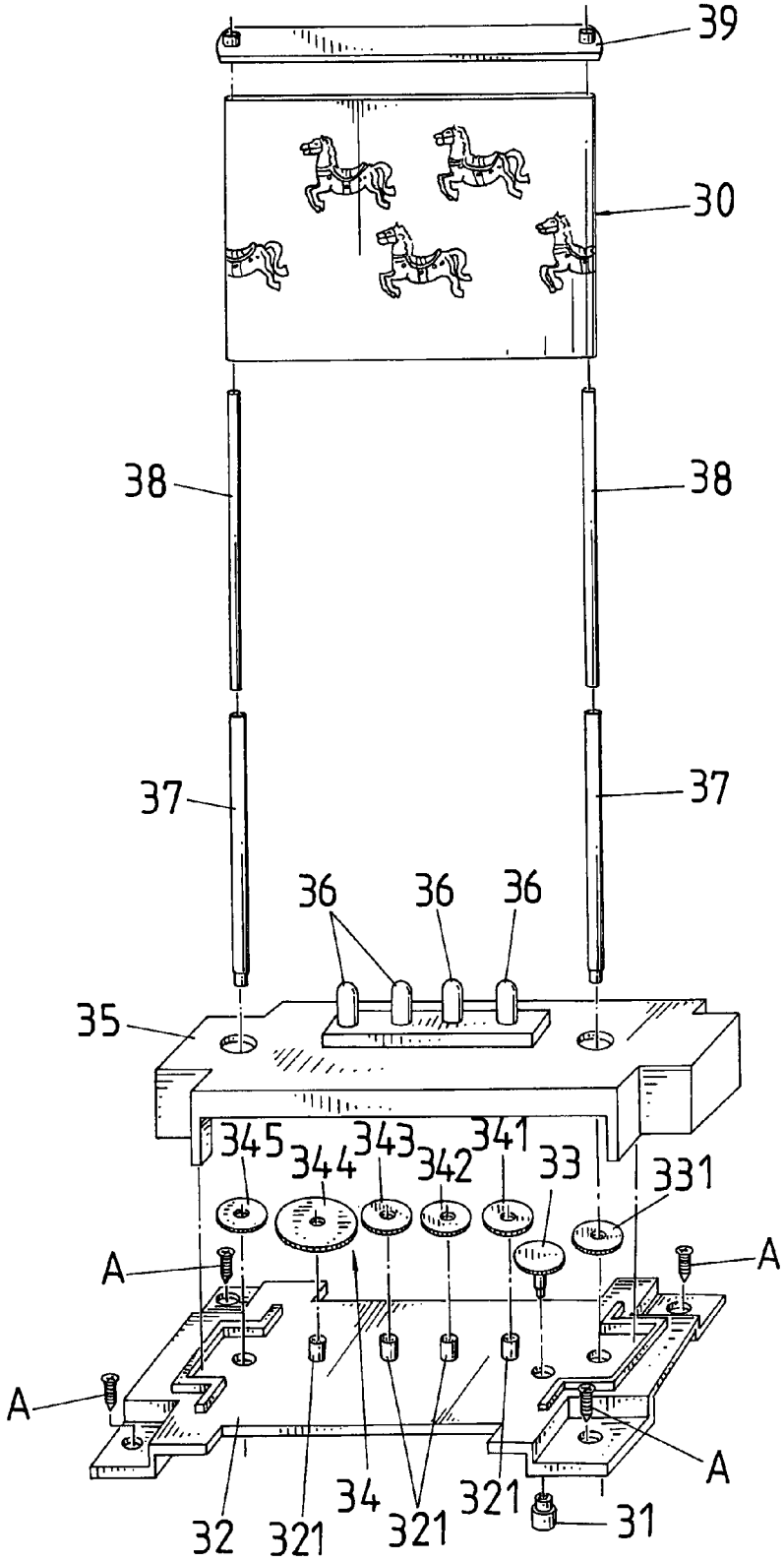
FIG. 4 shows an exploded elevational view of the rotary screen mechanism according to the present invention.

Referring to FIGS. 1 and 2, which show the present invention primarily structured to comprise a motor mechanism 10, a gear mechanism 20, a rotary screen mechanism 30 and a crystal ball 40

Figure 5:
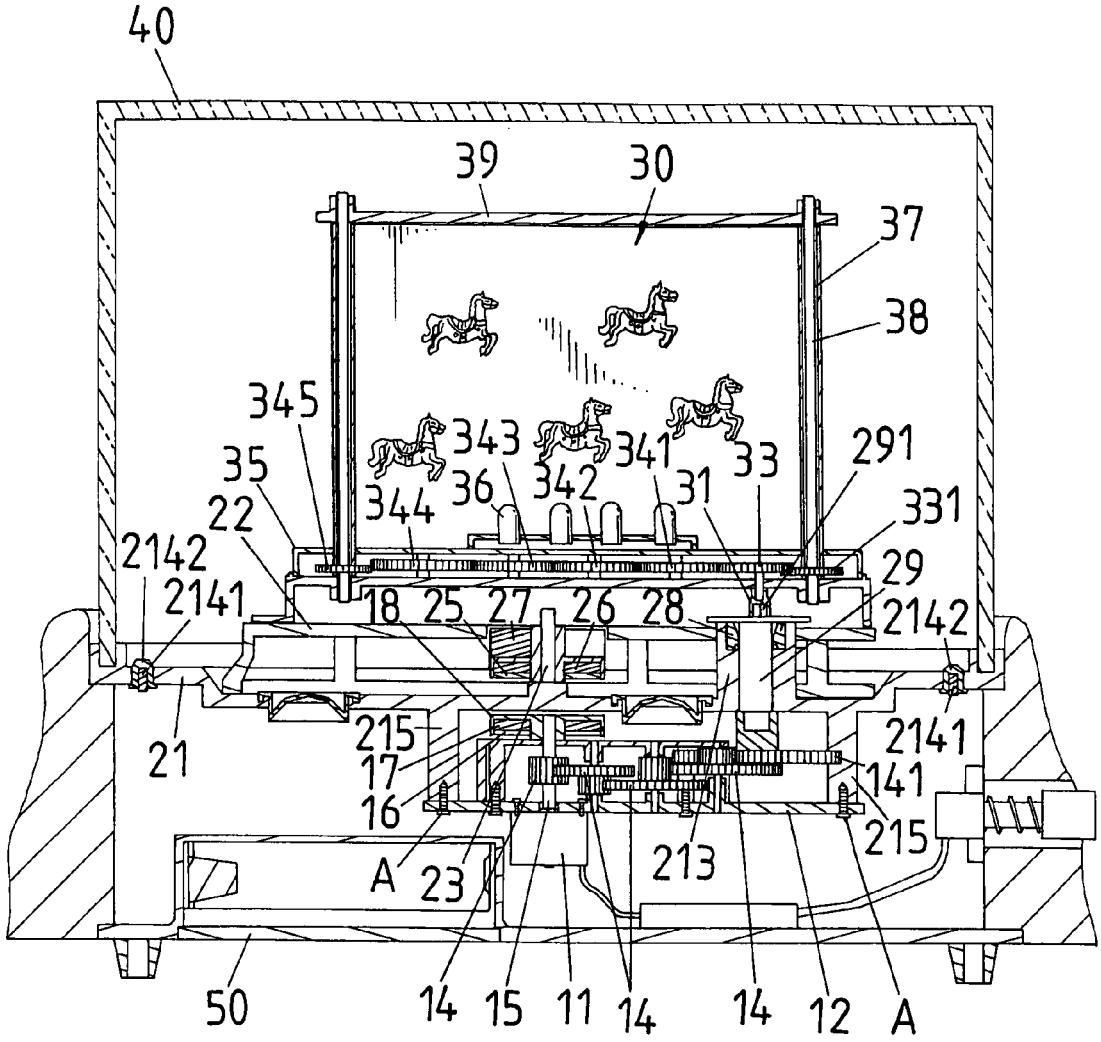
FIG. 5 shows a cross-sectional view of the present invention.

Referring to FIG. 5, which shows a base 50 disposed beneath the crystal ball 40 used to retain the aforementioned mechanisms, wherein the crystal ball 40 is filled with water and shiny disc snowflakes (not shown in the drawings). The motor mechanism 10 is installed beneath the gear mechanism 20, and the rotary screen mechanism 30 is installed above the bushings 37, and horses or other ornaments are disposed on the rotary screen mechanism 30. The top gland 39 caps the two transmission bushings 37 and is shaft joined to the fixing shafts 38.

Referring to FIG. 5, when the motor 11 drives and rotates the transmission gears 14, 141, apart from mutual repelling of the upper and lower double-sided magnets 26, 17 driving and rotating the magnet impeller wheel 27, and thereby causing the whirling of water and fluttering of shiny disc snowflakes, moreover, the main transmission gear 33 is also driven, thereby causing rotation of the two transmission gears 331, 345. The two transmission gears 331, 345 then drive the fixing shafts 38 causing rotation of the transmission bushings 37, thereby driving and revolving the rotary screen mechanism 30. The crystal ball 40 can be square shaped or designed with different shapes, including circular shaped, diamond shaped, and so on.

In conclusion, the crystal ball 40 of the present invention has functionality to give the impression of fluttering, striking shiny disc snowflakes of prior art, and additionally provides functionality to enable revolving of the rotary screen mechanism 30. Furthermore, the crystal ball 40 of the present invention further enables configuration with a music bell.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A decorative device enabling ornaments to revolve on a rotary screen inside a crystal ball amidst fluttering, shiny disc snowflakes, comprising:

a motor mechanism, comprising:

a motor;

a gear set supporting frame positioned above the motor;

a gear set gland that covers the gear set supporting frame;

a plurality of transmission gears positioned between the gear set supporting frame and the gear set gland; and which mutually mesh;

a plurality of gear shafts respectively extending into centers of the transmission gears;

a magnet gland positioned above the gear set gland that enables the gear shafts to penetrate therethrough;

a double-sided magnet positioned above the magnet gland that enables the gear shafts to penetrate therethrough;

a transmission magnet gland positioned above the double-sided magnet that enables the gear shafts to penetrate therethrough;

a gear mechanism, comprising:

a carrier frame, an upper surface of which is provided with a recess, two air rubber plug holes and a watertight ring support;

a gland that covers the recess of the carrier frame, and a plurality of bolt holes are defined in the gland;

a magnet impeller shaft positioned center of the recess of the carrier frame;

two air rubber plugs that are respectively fixedly plugged into the air rubber plug holes;

a magnet gland positioned in the gland that enables the magnet impeller shaft to penetrate therethrough;

a double-sided magnet positioned above the magnet gland that enables the magnet impeller shaft to penetrate therethrough;

a magnet impeller positioned above the double-sided magnet that enables the magnet impeller shaft to penetrate therethrough a watertight gasket positioned within the watertight ring support of the carrier frame;

a main transmission shaft that penetrates the watertight gasket and extends into the watertight ring support of the carrier frame, an upper portion of the main transmission shaft is provided with an embedding piece;

a rotary screen mechanism, comprising:

a main power transmission member embedded to an embedding piece of the main transmission shaft;

a gear set supporting frame fixedly bolted to the gland of the gear mechanism using screws, an upper surface of the gear set supporting frame is provided with a plurality of position fixing shafts;

a main transmission gear joined to the main power transmission member, and an end is connected to a transmission gear;

a transmission gear set assembled from a plurality of mutually meshing gears, the gears are respectively shaft joined to the position fixing shafts of the gear set supporting frame, one end of the transmission gear set meshes with a transmission gear, and another end meshes with the main transmission gear;

a gear set gland that covers the gear set supporting frame, thereby covering the transmission gear set, an upper surface of the gear set gland is configured with a plurality of light-emitting diodes;

two transmission bushings, fixing shafts interior thereof respectively penetrate the gear gland set and are shaft joined to the transmission gears;

a rotary screen wire wrapped connected to the two transmission bushings;

a gland that covers the two transmission bushings and which are shaft joined to the fixing shafts;

when the motor mechanism drives and rotates the main transmission gear, then driving of the two transmission gears drives the fixing shafts and rotates the transmission bushings, thereby causing the rotary screen mechanism to revolve.

* * * * *